US005256255A

United States Patent [19]

Fagerlund

[11] Patent Number: 5,256,255

[45] Date of Patent: Oct. 26, 1993

[54] DISPLACEMENT HEATING IN CONTINUOUS DIGESTERS

[75] Inventor: Bertil K. E. Fagerlund, Ponte Vedra, Fla.

[73] Assignee: Beloit Technologies, Inc., Wilmington, Del.

[21] Appl. No.: 856,859

[22] Filed: Mar. 24, 1992

Related U.S. Application Data

[63] Continuation of Ser. No. 413,920, Sep. 28, 1989, abandoned.

[51] Int. Cl.[5] ..... D21C 7/10; D21C 7/14

[52] U.S. Cl. ..... 162/237; 162/37; 162/39; 162/47; 162/239; 162/249; 162/250

[58] Field of Search ..... 162/19, 29, 37, 39, 162/47, 59, 237, 239, 250, 242, 248, 249; 422/185

[56] References Cited

U.S. PATENT DOCUMENTS

| | | | |
|---|---|---|---|
| 1,646,084 | 10/1927 | Dunbar | 162/248 |
| 1,829,378 | 10/1931 | Thiriet | 162/239 |
| 2,675,311 | 4/1954 | Natwick | 162/19 |
| 3,308,088 | 2/1967 | Gessner | 162/248 |
| 3,537,953 | 11/1970 | Brown et al. . | |
| 3,801,431 | 4/1974 | Ingemarsson | 162/19 |
| 4,123,318 | 10/1978 | Sherman | 162/19 |
| 4,248,662 | 2/1981 | Wallick | 162/29 |
| 4,578,149 | 3/1986 | Fagerlund | 162/47 |
| 4,764,251 | 8/1988 | Östman . | |
| 4,849,059 | 7/1989 | Grant | 162/47 |
| 4,954,219 | 9/1990 | Gloersen . | |

FOREIGN PATENT DOCUMENTS

| | | |
|---|---|---|
| 0135461 | 3/1985 | European Pat. Off. . |
| 2519357 | 7/1983 | France . |
| 2526060 | 11/1983 | France . |
| 8502423 | 6/1985 | World Int. Prop. O. . |

OTHER PUBLICATIONS

"The Kamyr Continuous Digester", Pulp & Paper, 3rd Ed. pp. 386-391.

*Primary Examiner*—W. Gary Jones
*Assistant Examiner*—Todd J. Burns
*Attorney, Agent, or Firm*—Dirk J. Veneman; Raymond W. Campbell

[57] ABSTRACT

An apparatus and method for treating cellulosic wood chips in a digestion process for the liberation of pulp in a caustic hydroxide solution at high pressures and temperatures by delivering preconditioned wood chips to a first chamber and circulating a low temperature black liquor through the chamber to preheat the chips, while continuously feeding the chips through the chamber to a second chamber at high temperature and pressure, circulating high temperature black liquor to the chips in the second chamber to advance them to cooking temperature, feeding white liquor and the chips to a digester for the digestion process over a predetermined period of time, and removing digested pulp and delivering the pulp to a washer with the black liquor for washing being utilized for the first chamber, and heating the white liquor through a heat exchange process with the high temperature black liquor.

6 Claims, 2 Drawing Sheets

DISPLACEMENT HEATING IN CONTINUOUS DIGESTERS

This is a continuation of copending appllication(s) Ser. No. 07/413,920 filed on Sep. 28, 1989, now abandoned.

TECHNICAL FIELD OF THE INVENTION

The present invention relates to improvements in apparatus and methods for the fiber liberating digestion of continuously fed comminuted cellulosic fiber material by cooking liquor and subsequent washing of the liberated fiber material. More particularly, the invention relates to an improved apparatus and process utilizing spent black liquor for heating the chips to effect savings in thermal energy, and for accomplishing high sulfidity cooking without changes to the overall sulfide balance of the system to accomplish a pulp having improved mechanical characteristics, to improve pulp yield, and to achieve extended delignification.

BACKGROUND OF THE INVENTION

In producing chemical wood pulps, it has become the practice to use cooking liquors containing various cooking chemicals for liberating the pulp fibers. The so-called kraft or sulphate pulp is produced by cooking the raw chipped wood in a liquor wherein materials such as sodium hydroxide and sodium sulfide serve as the essential fiber liberating chemicals. The so-called soda pulp derives its name from the caustic soda-containing cooking liquor which is produced, namely a liquor containing principally caustic soda as the active pulping chemical. There are modifications of these processes based on the use of liquors containing caustic soda and sodium sulphite or containing caustic soda, and sodium sulphide. All of these processes are, however, performed similarly with respect to the cooking being effected with an amount of liquor over a period of time requiring the addition of heat to maintain the process at the proper cooking temperature, approximately 170° C.

Two basic processes have been used for performing the chip cooking. The first is batch cooking in which the chips are placed in a digester, liquor is added, the temperature and pressure are raised and the "batch" is maintained at the elevated temperature and pressure to reach the desired stage of delignification. The digester is then emptied, and a subsequent fill is started for another batch. In continuous digesting, the second basic process, a chip column continuously moves through the digester with hot liquor circulating therethrough. Process conditions are controlled such that the desired stage of delignification has occurred when the chips flow out of the digester.

Various advances have been made in batch cooking processes utilizing spent liquor or black liquor in transferring heat to the chips, but effective heat conserving processes for continuous cooking have not been developed to an advanced stage for attaining maximum heat energy conservation.

In conventional continuous digesters, the spent liquor is allowed to flash and steam is generated. The steam is normally utilized to pre-steam the chips and to generate hot water. The heat and cooking chemicals could be utilized more efficiently if the spent liquors were used to preheat and precondition the chips and to preheat the cooking chemicals such as white liquor in kraft processes which enters the process.

SUMMARY OF THE INVENTION

It is accordingly an object of the present invention to provide a continuous digestion cooking process wherein an improved saving in thermal energy is effected.

A further object of the invention is to provide a continuous digestion process wherein the used black cooking liquors and the white liquors are utilized in a unique manner in the process so as to obtain a saving in thermal energy, and to effect an improvement in the resultant qualities of the pulp which is produced.

Yet another object of the present invention is to provide a process for achieving high sulfidity cooking without significant changes to the overall sulfide balance of the cooking system, and for achieving extended delignification in a continuous digesting system while improving pulp yield over existing continuous digesting systems.

A feature of the invention is the provision of a continuous digestion process wherein a plurality of chambers are used in sequence, with the first chamber receiving preconditioned chips and the chips being preimpregnated and heated in the first chamber with a low temperature black liquor. Further heating of the chips is accomplished with higher temperature liquors in the second and subsequent chambers, and after the chips are brought up to the desired elevated temperature, a white liquor is circulated through the chips at the digestion temperature and pressure. The chips are continuously fed from the last of the preimpregnation chambers to the digester for cooking. The cooked delignified chips are removed as pulp from the bottom of the digester and circulated to final washing. The wash liquor from the washer is utilized in two or more stages to displace from the digester the free liquor and liquor within the chips.

In accordance with the principles of the present invention, the hot spent liquor is utilized to heat the incoming materials for the continuous digester. The spent liquor, having been extracted from the digester, is accumulated in pressure vessels substantially at digester temperature. Lower temperature liquors from final displacement stages are also accumulated. The incoming chips are first exposed to the lower temperature liquors and then the higher temperature liquors. The white liquor is preheated in a heat exchanger, utilizing a portion of hot spent liquor. The white liquor can be stored in a hot white liquor accumulator whereas the hot spent liquor, after having given energy to the white liquor, goes to the low temperature accumulator.

Practically, the process can be accomplished wherein a first initial chamber or vessel is utilized, being fed by a screw conveyor feeder to press the chips downwardly. The vessel may be employed with an extraction screen at the top and with a recirculation screen further down the vessel, with the recycled liquor flowing through a central pipe ending at the screen level. Low temperature liquor is fed from a low temperature tank to a circulation pump, and the liquor is evenly spread over the vessel area. By extracting liquor from the top screen, a portion of the added liquor flows in a countercurrent path to the movement of the chips, thus transferring the heat and residual chemicals in the liquor to the chips. The duration of time that the chips are in that zone, and the liquor flow rate will determine the efficiency of the heat transfer. The amount of liquor extracted from the top screen is an amount that generally corresponds to the white liquor charge, wood moisture and the dilution factor. The extracted liquor goes to the evaporators. The remaining part of the liquor goes with the chips downwardly in the chamber.

The treatment with hot spent liquor takes place in a vessel at principally digester pressure. Preferably, this high pressure vessel is located underneath the first vessel, and the transfer of material takes place in utilizing a high pressure feeder. The arrangement for heat exchange is, in principal, essentially the same as in the first lower temperature vessel. The hot spent liquor is introduced in a recirculation circuit, and a portion of the liquor flows countercurrent to the chips, being extracted from a top screen. Thus, the low temperature liquor is being displaced and substituted by a hot spent liquor. The low temperature liquor which leaves the top screen is conveyed back to the low temperature tank.

A portion of the hot spent liquor is utilized to preheat the white liquor that is introduced in the bottom of the high pressure vessel. In the event a mechanical device is utilized to feed chips out of the high pressure vessel, white liquor should be added after that mechanical device to avoid pulp deterioration. This can be done by utilizing a vessel which forms part of the continuous digester and is integrated into the digester apparatus itself.

Other objects, advantages, and features will become more apparent with the teaching of the principles of the invention in connection with the disclosure of the preferred embodiments thereof in the specification, claims, and drawings, in which:

DESCRIPTION OF THE PREFERRED EMBODIMENTS

Figure 1:
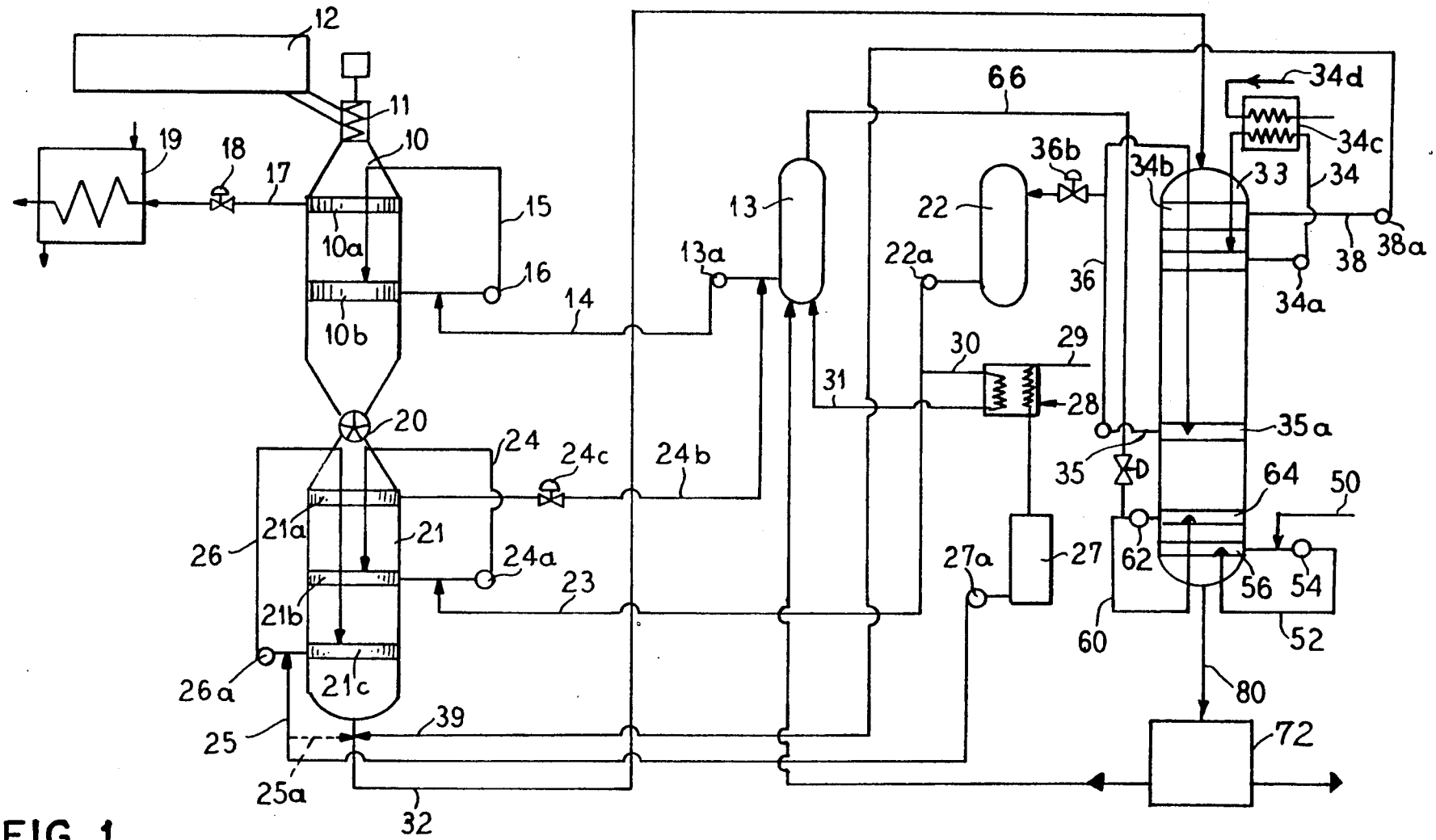
FIG. 1 is a schematic drawing of a process for operating in accordance with the principles of the present invention.

As illustrated in FIG. 1, wood chips are delivered to a first chamber or container 10 through a screw delivery mechanism 11. The chips may be preconditioned, such as by being heated by steam, in a supply container 12.

In the first container, which is a warm liquor preimpregnator, the preheating occurs by a supply of low temperature black liquor supplied from a low temperature black liquor tank 13 through a supply line 14. The black liquor is circulated through the chips through a recirculating mechanism including a recirculating line 15 and a recirculating pump 16.

Excess black liquor, after having spent its heat energy and residual chemicals, is removed near the top of the chamber 10 through a line 17 controlled by a valve 18 to flow to an evaporator 19 where the black liquor is reprocessed and reclaimed in the manner which will be recognized and understood by those versed in the art. Screens 10*a* and 10*b* are provided for the liquor outlets to the evaporator 19 and the recirculating line 15, respectively.

In the process depicted in FIG. 1, preheated wood chips are forcibly conveyed downwardly to a second chamber 21, which is a hot liquor preimpregnator in which the wood chips are subjected to liquor for a predetermined time at a higher temperature and high pressure than in the first container. For delivery the wood chips to the second chamber 21 a mechanism such as a rotary delivery valve 20 is employed. Such valves are well-known to those skilled in the art and will not be described further herein.

To preheat the chips in the hot liquor preimpregnator to approach the digestion temperature, hot black liquor is delivered to the second chamber by line 23, which receives hot black liquor from a hot black liquor tank 22 delivered by a pressure pump 22a. The hot black liquor is recirculated through the moving chips by recirculation line 24, with the liquor being circulated by a pump 24*a*. A portion of the liquor is removed through a line 24*b*, controlled by a valve 24*c*, to be delivered back to the low temperature black liquor tank 13, preferably upstream of a delivery pump 13*a* which pumps the low temperature black liquor to the first chamber 10.

Arranged in the second chamber 21 are screens 21*a*, 21*b*, and 21*c*, which allow for the removal of the liquor, with the screen 21*a* facilitating the removal of the excess black liquor through the line 24*b*, and the screens 21*b* and 21*c* facilitating the recirculation of the high temperature black liquor in two recirculation paths.

For the digestion process, white liquor is delivered to the second chamber 21 through a line 25. Alternatively, the white liquor can be supplied through a line 25*a*, shown by dotted line in FIG. 1, as the chips leave the second chamber.

The white liquor is obtained from a high temperature white liquor tank 27, being delivered therefrom by a pump 27*a*. The white liquor is preheated before delivery to the second chamber 21 in a heat exchanger 28, with the white liquor being supplied to the heat exchanger from a supply source not shown and a supply line 29. The heat exchanger is heated by hot black liquor supplied through a line 30 leading from the high temperature black liquor tank 22, and, after passing through the heat exchanger, the black liquor flows through a line 31 to the low temperature black liquor tank 13.

The preimpregnated chips and cooking liquor exit the bottom of the second chamber 21 through a discharge line 32, which connects the bottom of the second chamber 21 to the upper end of the digester 33. Cooking liquor is recirculated at the top of the digester through a circuit 34 having a recirculation pump 34*a* and extraction screen 34*b* therein. Temperature adjustment of the cooking liquor may be achieved with a trim heat exchanger 34*c* heated by steam from a steam source 34*d*. A portion of the cooking liquor is removed from the digester through a line 38 by a pump 38*a*, and is delivered through a line 39 to the location where the chips exit the second chamber. This recirculated cooking liquor further dilutes the chips and liquor exiting the second chamber to facilitate transport of the chips to the digester.

In the digester 33, the chips move continuously downward, and are cooked to the desired level of delignification. Recirculation takes place through an extraction line 35, an extraction screen 35*a*, a recirculation line 36, and a pump 36*a*. A portion of the recirculated liquor is directed to the black tank 22, controlled by a valve 36*b*.

In the lower part of the digester, washer filtrate from a line 50 is recirculated through a circuit 52 by a pump 54, to eliminate temperature and spent liquor concentration gradients. The filtrate is added between an extraction screen 56 and the pump 54, so that the extracted liquor volume is less than the flow into the digester through circuit 52, causing an upward flow of filtrate in the bottom of the digester. A second recirculation circuit 60, including a pump 62, is provided to extract a portion of the upward flowing filtrate at an extraction screen 64, together with remaining hot spent black liquor. A portion of the extracted filtrate and liquor is directed to the low temperature tank 13, through line 66 controlled by a valve 68.

A blow line 80 is provided for removing pulp from the digester to a washer 72. The manner in which the pulp is moved from the digester, including any secondary dilution, is well-known in the art of continuous digesters and will not be described further herein.

In operation, preconditioned pulp is delivered via a screw conveyor 11 into a first chip preheating chamber 10 where it is heated by low temperature black liquor obtained from a low temperature black liquor tank 13. The preheated chips pass downwardly through a rotary delivery valve 20 to a second chamber 21, where the chips are further preheated by high temperature black liquor received from a high temperature black liquor tank 22.

The high temperature and low temperature black liquors are obtained from the pulp washer 72 with the high temperature liquor also being utilized for heating the white liquor through the heat exchanger 28. White liquor delivered through the screen **21*c* from a white liquor supply line 25, is added to the chips before the chips enter digester 33**.

In the digester, delignification takes place as the chip column and liquor move downwardly. The volume of filtrate added through supply line 50 should be sufficient to displace the free hot black liquor extracted through screen **35*a* and the warm liquor extracted through screen 64. The countercurrent flow of liquor in the area between screen 35*a* and screen 64, and between 64 and screen 56 creates a condition in which liquor held by the chips is displaced and removed, so that the chips leaving through blow line 80** are substantially free from cooking liquor.

The region of the countercurrent flow between screen 64 and screen **35*a* should be sufficiently long that the filtrate is heated by the chips substantially to cooking temperature, and the liquor and filtrate removed through line 35** are at or near cooking temperature.

It is known that the sulphide ions in cooking liquors that are absorbed by the chips prior to cooking are liberated from the wood chips later in the cooking process, so that approximately 90 percent of the sulphide is left in the spent liquors. It is critical to cooking selectivity to precondition chips with sulphide prior to bulk delignification. In the present invention, liquor leaving the top of the first chamber contains essentially the same amount of sulphide as conventional spent liquors going to evaporation. The sulphide concentration in the low temperature tank is even higher than that coming from the first chamber, and the sulphide concentration in the hot black liquor tank is even higher. These concentrations, in combination with the elevated temperatures, give an efficient preconditioning of the wood chips with sulphide prior to cooking.

Figure 2:
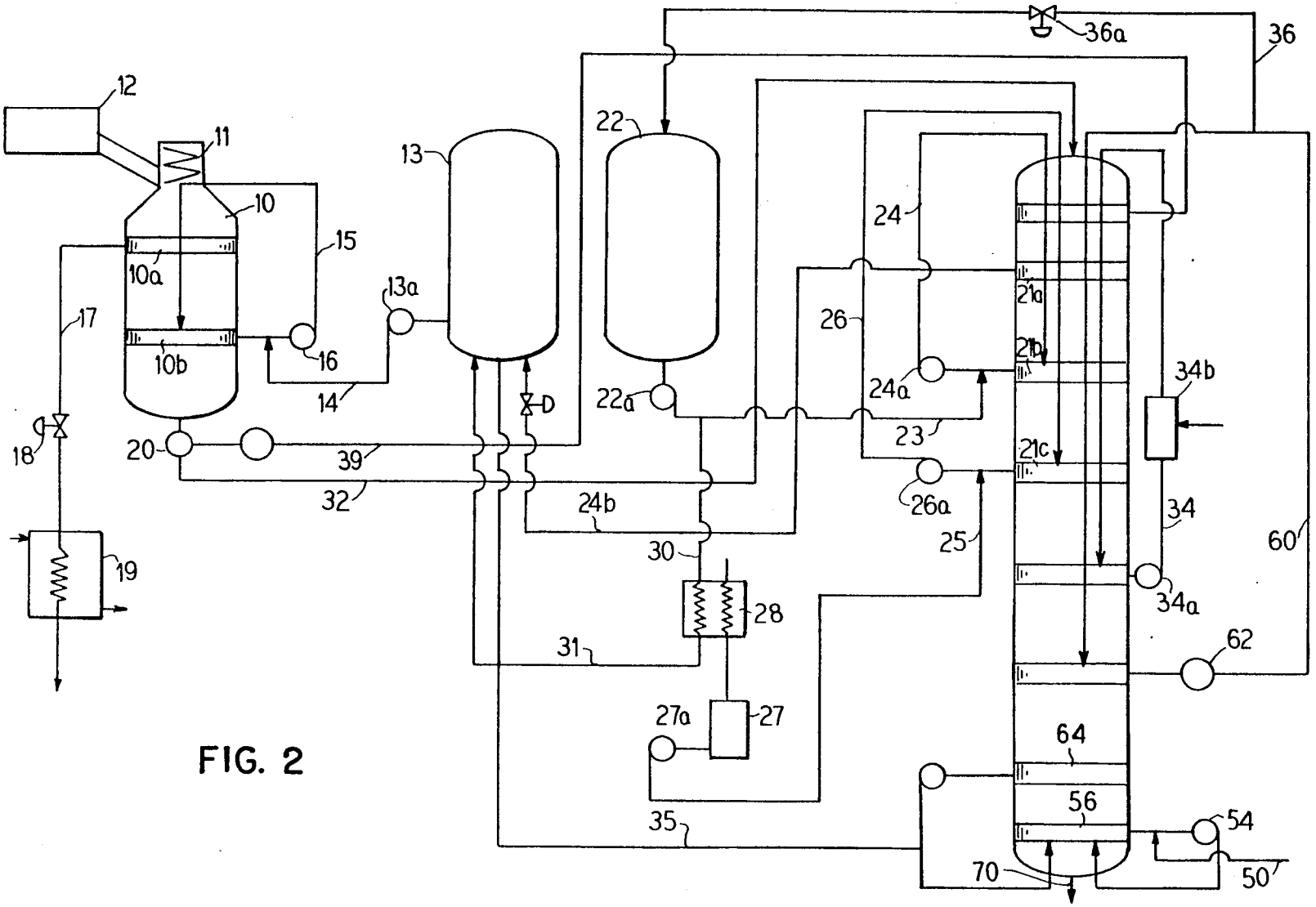
FIG. 2 is a schematic drawing of a modification of the process shown in FIG. 1, wherein the high pressure preimpregnation vessel forms a part of the continuous digester.

It should be recognized that the various components of the present process can be rearranged to achieve the desired preimpregnation and preheating, with appropriate recirculation. Additional preimpregnation containers can be utilized, joined as shown in FIG. 1, or by other suitable means. The two container process described also can be alternatively arranged. For example, FIG. 2 illustrates, in schematic format, a process in which the second chamber 21 is continguous with the digester. Corresponding parts of the process depicted in FIG. 2 have been numbered similarly to FIG. 1. Thus, the various extraction screens, recirculation circuits, pumps, and the like for both the high pressure preimpregnation process and the final digestion process are contained in the combined preimpregnation and digester vessel.

Thus, it will be seen that I have provided an improved method and apparatus for a continuous digestion process which meets the objectives and advantages above set forth. It will be recognized that various modifications of the process and apparatus within the spirit and scope of the invention may be employed without departing from the principles of the invention.

I claim:

1. A digester apparatus for the liberation of cellulosic fibrous material for papermaking pulp using cookingliquor ata high pressure and a high temperature in a continuous process, comprising in combination:

a first chamber;

feed means for delivering cellulosic wood chips to said first chamber and for transporting said chips through said first chamber in continuous transport;

a low temperature black liquor tank connected to the first chamber for circulating low temperature black liquor through the chips in said first chamber, at least a portion fof the black liquor flowing countercurrently to the downward movement of the chip column, the exchange of heat energy to increase the temperature of the chips and to convey residual chemicals to the chips;

a second chamber connected to receiver chips preheated by said low temperature liquor from the first chamber;

a feed mechanism connected between said chambers for delivering the chips to the second chamber continuously;

a high temperature black liquor tank connected to said second chamber for circulating high temperature black liquor through the chips in at leasst one liquor flow circuit moving countercurrently through the chips in said second chamber, for the exchange of heat energy to bring the temperature of the chips near digesting temperature and to convey residual chemicals to the chips;

an outlet means leading from the second chamber for a continuous delivery of preheated chips to a continuous digester, and means for supplying low temperature liquor to said low temperature liquor tank, and high temperature liquor to said high temperature liquor tank, said low and high temperature liquors being displaced from pulp treated in said digester and being supplied to said low temperature liquor tank and said high temperature liquor tanks.

2. A digester apparatus for the liberation of cellulosic fibrous material for papermaking pulp using cooking liquor at a high pressure and a high temperature in a continuous process constructed in accordance with claim 1:

including a white liquor recirculation means connected to the second chamber for recirculating white liquor countercurrent to the chip movement during the digesting process.

3. A digester apparatus for the liberation of cellulosic fibrous material for papermaking pulp using cooking liquor at a high pressur and a high temperature in a continuous process constructed in accordance with claim 1:

including a heat exchanger connected to the high temperature black liquor tank and connected to a white liquor container for increasing the temperature of the white liquor therein utilizing the thermal energy in the black liquor in said high temperature black liquor tank.

4. A digester apparatus for the liberation of cellulosic fibrous material for papermaking pulp using cooking liquor at a high pressure and a high temperature in a continuous process constructed in accordance with claim 3:

including means for supplying a white liquor supply to said white liquor container.

5. A digester apparatus for the liberation of cellulosic fibrous material for papermaking pulp using cooking liquor at a high pressure and a high temperature in a continuous process constructed in accordance with claim 1:

including a pulp washer connected to an outlet from the digester for receiving the delignified pulp from the digester and connected for delivering washing liquid to the low temperature tank for supplying wash liquid to the low temperature tank as said low temperature liquor.

6. A digester apparatus for the liberation of cellulosic fibrous material for papermaking pulp using cooking liquor at a high pressure and a high temperature in a continuous process constructed in accordance with claim 1:

including a liquor removal line connected to the first chamber for the removal of spent low temperature liquor.

* * * * *

UNITED STATES PATENT AND TRADEMARK OFFICE

CERTIFICATE OF CORRECTION

PATENT NO. : 5,256,255
DATED : 10/26/93
INVENTOR(S) : Bertil K.E. Fagerlund

It is certified that error appears in the above-indentified patent and that said Letters Patent is hereby corrected as shown below:

| | |
|---|---|
| Column 1, line 1 | "appllication(s) should read --application--. |
| Column 4, line 63 | "the black tank" should read --the hot black liquor tank--. |
| Column 6, lines 21 & 22 | "cookingliq-uor ata high" should read --cooking liquor at a high--. |
| Column 6, line 31 | "fof" should read --of--. |
| Column 6, line 36 | "receiver" should read --receive--. |
| Column 6, line 44 | "leasst" should read --least--. |

Signed and Sealed this

Thirty-first Day of May, 1994

Bruce Lehman

*Attest:*

BRUCE LEHMAN

*Attesting Officer*

*Commissioner of Patents and Trademarks*